US008177964B2

(12) United States Patent
Maria Gomes Soares et al.

(10) Patent No.: US 8,177,964 B2
(45) Date of Patent: May 15, 2012

(54) DELAYED COKING PROCESS WITH MODIFIED FEEDSTOCK

(75) Inventors: Gloria Maria Gomes Soares, Rio de Janeiro (BR); Natalie Jorge Goncalves, Rio de Janeiro (BR); Francisco Carlos Da Costa Barros, Nova Iguacu (BR); Sergio Cunha De Lucena, Rio de Janeiro (BR); Aline Voigt Nadolni, Rio de Janeiro (BR); Sergio Nunes Da Costa, Itaborai (BR)

(73) Assignee: Petroleo Brasileiro S.A.—Petrobras, Rio de Janeiro (BR)

( * ) Notice: Subject to any disclaimer, the term of this patent is extended or adjusted under 35 U.S.C. 154(b) by 238 days.

(21) Appl. No.: 12/374,856

(22) PCT Filed: Feb. 1, 2007

(86) PCT No.: PCT/GB2007/000342

§ 371 (c)(1),
(2), (4) Date: Jul. 8, 2009

(87) PCT Pub. No.: WO2008/012485

PCT Pub. Date: Jan. 31, 2008

(65) Prior Publication Data

US 2009/0314685 A1 Dec. 24, 2009

(30) Foreign Application Priority Data

Jul. 28, 2006 (BR) ..... 0603024

(51) Int. Cl.
*C10G 9/14* (2006.01)

(52) U.S. Cl. ..... 208/93; 208/94; 208/131

(58) Field of Classification Search ..... 208/50, 208/67, 72, 75, 92–94, 100, 131
See application file for complete search history.

(56) References Cited

U.S. PATENT DOCUMENTS

| | | | | |
|---|---|---|---|---|
| 4,036,736 | A | | 7/1977 | Ozaki et al. |
| 4,455,219 | A | | 6/1984 | Janssen et al. |
| 4,518,487 | A | | 5/1985 | Graf et al. |
| 4,661,241 | A | | 4/1987 | Dabkowski et al. |
| 4,670,133 | A | * | 6/1987 | Heaney et al. ..... 208/131 |
| 5,711,870 | A | | 1/1998 | Storm et al. |

FOREIGN PATENT DOCUMENTS

| | | | |
|---|---|---|---|
| GB | 2140028 | A | 11/1984 |
| WO | 2005/113709 | A | 12/2005 |
| WO | 2005/113710 | A | 12/2005 |

* cited by examiner

*Primary Examiner* — Walter D Griffin
*Assistant Examiner* — Renee E Robinson
(74) *Attorney, Agent, or Firm* — Sughrue Mion, PLLC

(57) ABSTRACT

A process of delayed coking with modified feedstock is described maximising the volume of diesel oil and minimising the volume of coke produced by means of feedstock which comprises, in a first embodiment of the invention: the bottom product (8) of the vacuum distillation tower (6), known in the prior art as vacuum residuum, and a fraction (7') of heavy vacuum gas oil (7) obtained in the aforesaid vacuum distillation. In a second embodiment of the present invention the bottom residuum (5) proceeding from the atmospheric distillation tower (2), known in the prior art as atmospheric residuum, is employed as feedstock of a Delayed Coking Unit (9).

4 Claims, 3 Drawing Sheets

DELAYED COKING PROCESS WITH MODIFIED FEEDSTOCK

BACKGROUND OF THE INVENTION

The field of application of the present invention is delayed coking processes. Particularly within the processes of modification of feedstock for a Delayed Coking Unit in order to increase production of diesel oil and reduce production of coke.

DESCRIPTION OF PRIOR ART

The process of delayed coking of residual petroleum fractions has been employed in the petroleum refining industry for some time. This process permits the conversion of heavy petroleum fractions into lighter products having greater value added such as, for example, liquefied petroleum gas (LPG), naphtha and gas oils from coke.

In a conventional delayed coking process the new feedstock, generally a vacuum residuum, is fed to the bottom region of the fractionation tower wherein incorporation of the natural recycle occurs forming the combined feedstock of the Unit. Normally the natural recycle is employed to adjust the quality of heavy gas oil from coke to be sent to any Fluid Catalytic Cracking (FCC) Unit.

The combined feedstock is sent to a furnace wherein it must dwell for a very short time, of the order of a few minutes, such that the thermal cracking reactions can be initiated and the formation of coke in the furnace tubes be minimised.

On leaving the furnace at a temperature of the order of 500° C. the cracked feedstock is fed to the coke drum wherein the thermal cracking and coking or carbonisation reactions are completed. These reactions generate hydrocarbons lighter than those in the combined feedstock and coke. The reactions which take place in a coke drum are endothermic and the temperature of the effluents from the drum lie within a band of values from 425° C. to 455° C.

The coke formed accumulates in the drum until it requires to be removed following stages of steam purging and cooling with water. With the objective of removing the accumulated coke in a coke drum the effluent from the coke drum is diverted to another empty coke drum wherein the accumulation phase is initiated. Removal of the coke is carried out by means of high-pressure-water cutting devices.

The effluents from the coke drum are then sent to a fractionation tower of a Delayed Coking Unit wherein they are separated into:

- A mixture of fuel gas, LPG and light naphtha exiting from the top of the fractionation tower, known for this reason in the prior art as top gases; and
- Side drawings of heavy naphtha, light gas oil (LGO) from coke and heavy gas oil (HGO) from coke.

In order to achieve better operational yield special care is taken at some stages of the delayed coking process, i.e.:

- It is desirable that coke formation occurs solely within a coke drum and not within the tubes of the furnace. Thus the combined feedstock dwells in the furnace for solely a few minutes in order to minimise the formation of coke within the tubes thereof; and
- In order to prevent the reactions proceeding and possible undesirable deposition of coke in the outlet tubing of the coke drum a rapid cooling (quench) is carried out employing a stream of gas oil and/or residuum.

With the discovery of increasingly-heavy petroleums the delayed coking process in refineries has experienced an increase in its degree of importance, principally due to an increase in the yield of residuum from such petroleums.

The delayed coking process is well-known in the prior art. One of the oldest processes is disclosed by U.S. Pat. No. 3,563,884. The aforesaid patent describes a process wherein tar is utilised as raw material and a heavy gas oil recycle is provided for.

Some variations have been introduced based on the aforesaid invention. U.S. Pat. No. 4,213,846 discloses a delayed coking process for the formation of premium coke wherein the recycle is hydrotreated.

U.S. Pat. No. 4,177,133 describes a delayed coking process for the formation of premium coke wherein the new feedstock having passed through a preheating stage is subjected to flash distillation to remove non-crystalline substances.

U.S. Pat. No. 4,455,219 and U.S. Pat. No. 4,518,487 disclose a delayed coking process wherein part or all of the heavy hydrocarbon product commonly used as recycle is replaced by a lighter hydrocarbon, which same is combined with the new feedstock of the unit.

U.S. Pat. No. 4,661,241 describes a delayed coking process wherein the yield of coke is minimised and the yield of liquid products is maximised by means of the elimination of recycle.

U.S. Pat. No. 5,711,870 discloses a process of delayed coking wherein the fresh feedstock is mixed with water and, optionally, with a hydrogen donor such as methane or gas oil derived from the recycle in order to optimise the yield of liquid products and reduce the yields of coke and gas.

As may be observed there is a tendency to develop delayed coking processes with the objective of maximising the yield of liquid products, principally petrol, and reducing the yield of coke and gas. In order to achieve this objective there is a tendency to reduce the rate of recycle of the delayed coking process and increase the conditions of severity in the vacuum distillation tower in order to maximise separation of heavy vacuum gas oil.

In this manner the quality of production of a heavy vacuum gas oil suitable for use as feedstock for a Catalytic Cracking Unit is prioritised. This leads to the generation of increasingly heavy vacuum residuums at the bottom of the vacuum distillation tower.

Thus for refining programmes wherein there are excesses of gas oil and vacuum residuum and greater demand for diesel oil, the art is moving towards solutions making simultaneous conversion viable in order to maximise the production of diesel oil.

SUMMARY OF THE INVENTION

The process of delayed coking with modified feedstock, subject of the present invention, considers a solution maximising the volume of diesel oil and minimising the volume of coke produced, by means of modifications to the feedstock of a Delayed Coking Unit.

According to the present invention the feedstock consists of: bottom product from the vacuum distillation tower, known in the prior art as vacuum residuum, and heavy vacuum gas oil obtained in the aforesaid vacuum distillation.

In a first embodiment of the present invention the percentage by volume of heavy vacuum gas oil in the fresh charge lies within a range of values from 2% to 50%. Preferentially within a band of values comprised between 5% and 40%. Particularly within a band of values comprised between 10% and 30%.

In a second embodiment of the present invention the bottom residuum proceeding from the atmospheric distillation tower, known in the prior art as atmospheric residuum, is employed as feedstock of the unit.

BRIEF DESCRIPTION OF THE DRAWINGS

The process of delayed coking with modified feedstock, subject of the present invention, will be better understood by means of the detailed description given below solely as an example, in association with the drawings referred to below, which same are integral parts of this description.

DETAILED DESCRIPTION OF THE INVENTION

The description of the process of delayed coking with modified feedstock, subject of the present invention, will be provided in concordance with the identification of the respective components, based on the figures described above.

Figure 1:
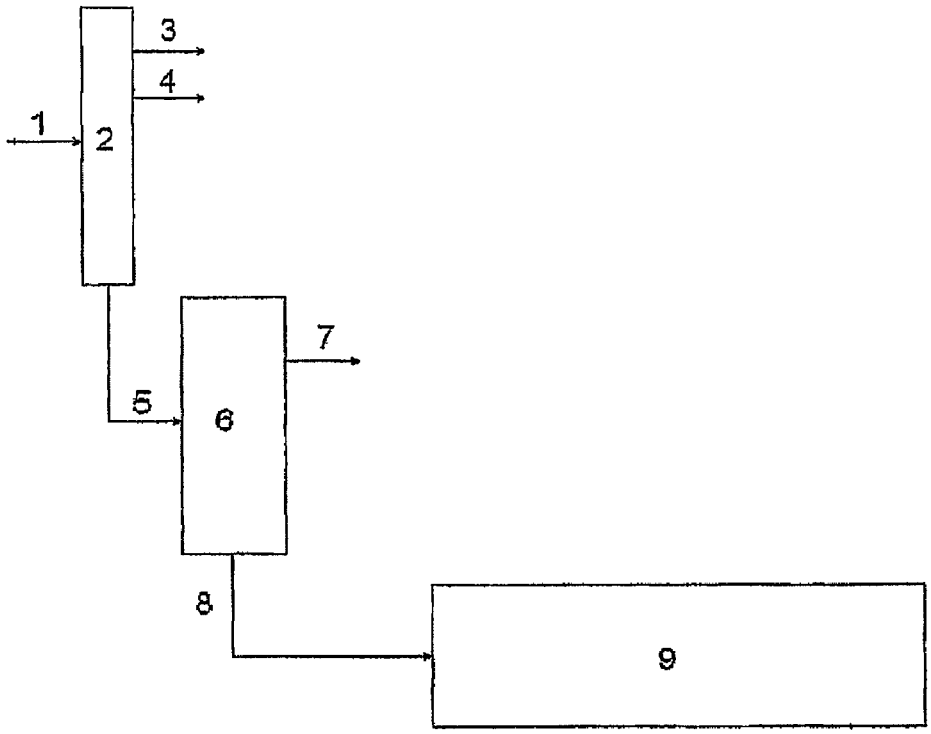
Figure 1 PRIOR ART
FIG. 1 shows schematically the items of equipment involved in a delayed coking process according to the prior art.

FIG. 1 shows schematically the items of equipment involved in a delayed coking process according to the prior art. Petroleum (1) is fed to an atmospheric distillation tower (2) whence diverse derivatives are removed such as, for example, fuel gas (3), naphtha (4) and others not shown in this Figure. In addition the bottom product (5) of the atmospheric distillation tower (2), known in the prior art as atmospheric residuum, is fed to a vacuum distillation tower (6) whence diverse derivatives are removed such as, for example, heavy vacuum gas oil (7), other derivatives not shown in this figure and a bottom product (8), known in the prior art as vacuum residuum. The bottom product (8) is sent to a Delayed Coking Unit (9) and the heavy vacuum gas oil (7) is sent to a Catalytic Cracking Unit (not shown in the Figure).

Figure 2:
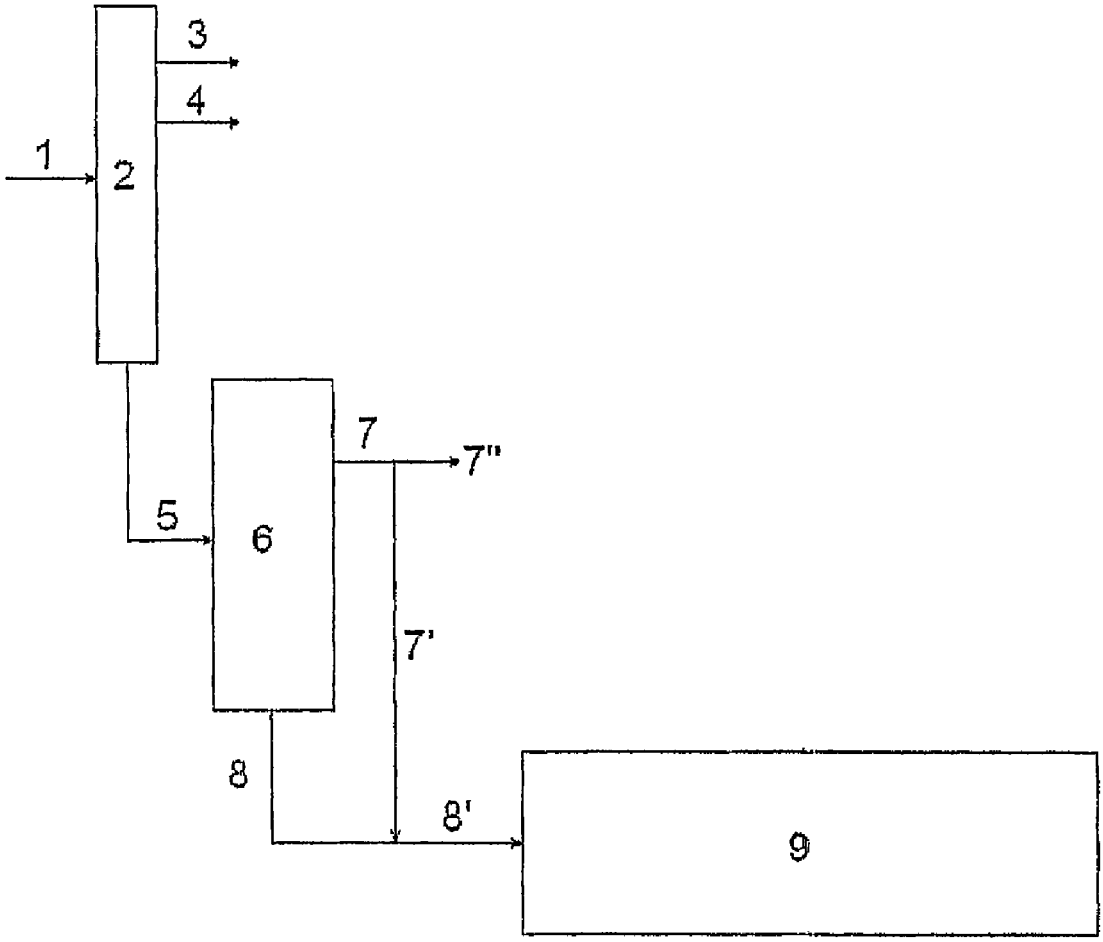
FIG. 2 shows schematically the items of equipment involved in a process of delayed coking with modified feedstock, according to a first embodiment of the present invention.

FIG. 2 shows schematically the items of equipment involved in a delayed coking process with modified feedstock according to a first embodiment of the present invention. Petroleum (1) is fed to an atmospheric distillation tower (2) whence diverse derivatives are removed such as, for example, fuel gas (3), naphtha (4) and others not shown in this figure. In addition the bottom residuum (5) of the atmospheric distillation tower (2), known in the prior art as atmospheric residuum, is fed to a vacuum distillation tower (6) whence diverse derivatives are removed such as, for example, heavy vacuum gas oil (7), other derivatives not shown in this figure and a bottom product (8), known in the prior art as vacuum residuum.

A fraction (7') of heavy vacuum gas oil (7) is added to the bottom product (8) of the vacuum distillation tower (6). The percentage by volume of the fraction (7') of heavy vacuum gas oil (7) added in relation to the vacuum residuum lies within a band of values from 2% to 50%. Preferentially within a band of values from 5% to 40%. Particularly within a band of values from 10% to 30%. The aforesaid portion (7') of heavy vacuum gas oil (7) may be added to the vacuum residuum by means of a line external to the vacuum distillation tower (6) according to the embodiment shown in FIG. 2.

Alternatively the aforesaid fraction (7') of heavy vacuum gas oil (7) may be added to the vacuum residuum within aforesaid vacuum distillation tower (6).

The feedstock thus combined (8') is subsequently sent to a Delayed Coking Unit (9) and the remaining portion (7") of heavy vacuum gas oil (7) is sent to a Catalytic Cracking Unit (not shown in the Figure).

Figure 3:
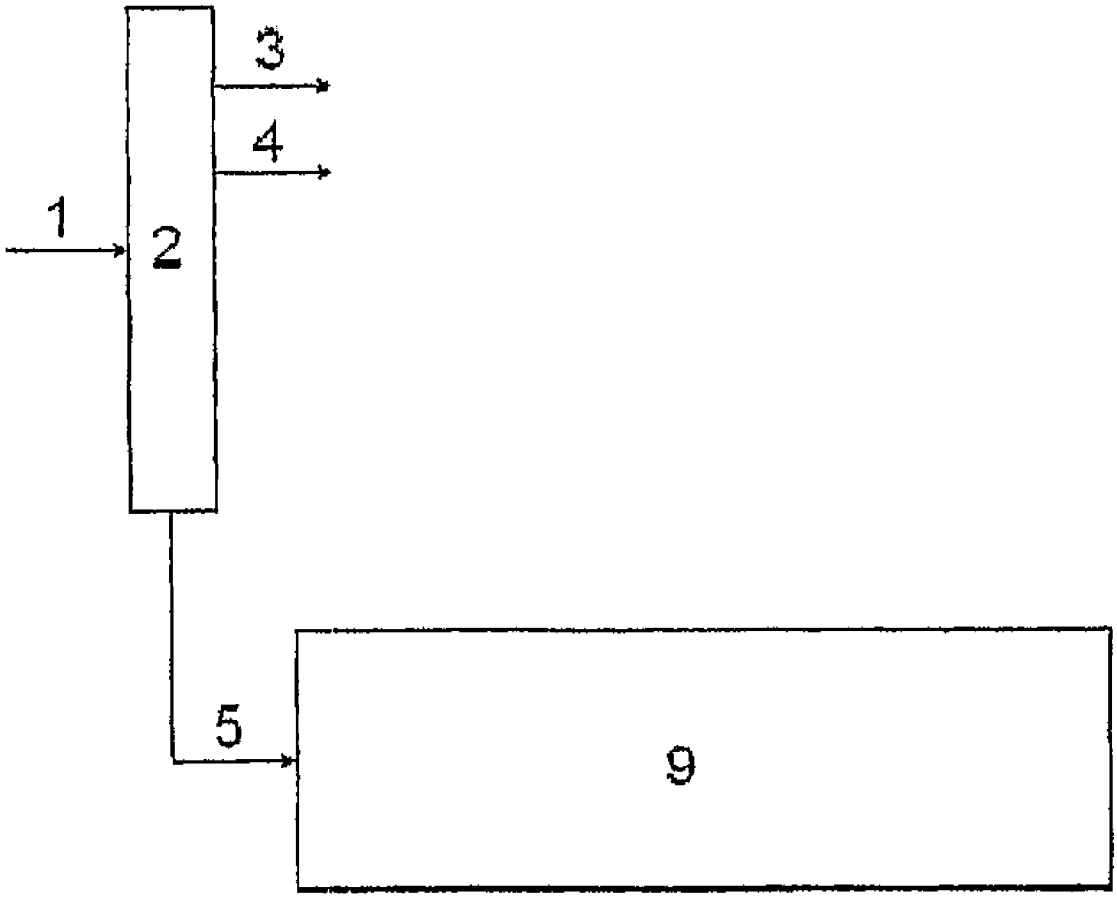
FIG. 3 shows schematically the items of equipment involved in a process of delayed coking with modified feedstock, according to a second embodiment of the present invention.

FIG. 3 shows schematically the items of equipment involved in a delayed coking process with modified charge according to a second embodiment of the present invention. With the objective of a greater increase in the volume of diesel oil produced and greater reduction in the volume of coke, petroleum (1) is fed to an atmospheric distillation tower (2) whence diverse derivatives are removed such as, for example, fuel gas (3), naphtha (4) and others not shown in this figure. The bottom residuum (5) of the atmospheric distillation tower (2), known in the prior art as atmospheric residuum, is sent to a Delayed Coking Unit (9). In this manner a vacuum distillation tower (6) is not employed, nor are products sent to a Catalytic Cracking Unit.

EXAMPLES

The present invention may be better understood by means of the examples below. However the examples do not limit the present invention. In the examples there have been employed: an atmospheric residuum (AR), a vacuum residuum (VR) and a heavy vacuum gas oil (HGO) having the properties according to Table 1:

TABLE 1

| | AR | VR | HGO |
|---|---|---|---|
| RCR (% w/w) | 7.3 | 15.0 | 0.59 |
| ° API | 14.3 | 9.5 | 18.4 |
| S (%) | 0.67 | 0.74 | 0.54 |

Example 1

A vacuum residuum was processed in a pilot delayed coking unit without heavy gas oil from coke recycle. The temperature of the furnace was 500° C. and the pressure at the top of the coke drum was 2 kgf/cm$^2$g. Volume yields of 51.3% for diesel oil and of 20.2% for heavy gas oil from coke were obtained. The mass yield of coke was 24.5%.

Example 2

A vacuum residuum was mixed with 20% by volume of a heavy vacuum gas oil. The combined feedstock was processed in a pilot delayed coking unit without heavy gas oil from coke recycle. The temperature of the furnace was 500° C. and the pressure at the top of the coke drum was 2 kgf/cm$^2$g. Volume yields of 52.2% for diesel oil and of 23.2% for heavy gas oil from coke were obtained. The mass yield of coke was 20.3%.

Example 3

An atmospheric residuum was processed in a pilot delayed coking unit without heavy gas oil from coke recycle. The temperature of the furnace was 500° C. and the pressure at the top of the coke drum was 2 kgf/cm$^2$g. Volume yields of 53.5% for diesel oil and 27.7% for heavy gas oil from coke were obtained. The mass yield of coke was 13.5%.

From the above examples there is noted an increase in yield in terms of diesel oil and a reduction in terms of coke. In this manner according to the herein described invention there occurs a growing increase in production of Diesel and a significant reduction in production of coke.

The description hereinbefore provided of the process of modification of a feedstock in a Delayed Coking Unit, subject of the present invention, must be considered solely as a possible embodiment or embodiments and any particular characteristics introduced therein shall solely be understood to be something described to facilitate comprehension. In this manner they cannot be considered to limit in any way the present invention which is restricted to the scope of the claims below.

The invention claimed is:

1. A process of delayed coking wherein petroleum (1) is fed to an atmospheric distillation tower (2) whence derivatives are removed in addition to a bottom residuum (5) of the atmospheric distillation tower (2), which is fed to a vacuum distillation tower (6) whence heavy vacuum gas oil (7) and/or a vacuum residuum (8) and/or one or more other derivatives are removed, wherein a fraction (7') of heavy vacuum gas oil (7) from the vacuum distillation tower (6) is added to the vacuum residuum (8) of the vacuum distillation tower (6) and this combined stream is a feedstock of a delayed coking unit (9), wherein the percentage by volume of the fraction (7') of heavy vacuum gas oil (7) added to the vacuum residuum is from 10% to 40%.

2. A process according to claim 1, wherein the aforesaid fraction (7') of heavy vacuum gas oil (7) is added to the vacuum residuum by means of a line external to the vacuum distillation tower (6).

3. A process according to claim 1, wherein the aforesaid fraction (7') of heavy vacuum gas oil (7) is added to the vacuum residuum within the vacuum distillation tower (6).

4. A process according to claim 1, wherein the percentage by volume of heavy vacuum gas oil (7) added to the vacuum residuum is from 10% to 30%.

* * * * *